US010084240B2

(12) United States Patent
Shamblin et al.

(10) Patent No.: US 10,084,240 B2
(45) Date of Patent: Sep. 25, 2018

(54) WIDEBAND WIDE BEAMWIDTH MIMO ANTENNA SYSTEM

(71) Applicant: ETHERTRONICS, INC., San Diego, CA (US)

(72) Inventors: Jeffrey Shamblin, San Marcos, CA (US); Laurent Desclos, San Diego, CA (US)

(73) Assignee: ETHERTRONICS, INC., San Diego, CA (US)

( * ) Notice: Subject to any disclaimer, the term of this patent is extended or adjusted under 35 U.S.C. 154(b) by 0 days.

(21) Appl. No.: 15/716,449

(22) Filed: Sep. 26, 2017

(65) Prior Publication Data

US 2018/0175511 A1 Jun. 21, 2018

Related U.S. Application Data

(62) Division of application No. 15/150,331, filed on May 9, 2016, now Pat. No. 9,819,095.

(60) Provisional application No. 62/159,103, filed on May 8, 2015.

(51) Int. Cl.

| | |
|---|---|
| ***H01Q 21/00*** | (2006.01) |
| ***H01Q 5/371*** | (2015.01) |
| ***H01Q 15/14*** | (2006.01) |
| ***H01Q 1/48*** | (2006.01) |

(52) U.S. Cl.

CPC ..... *H01Q 21/00* (2013.01); *H01Q 1/48* (2013.01); *H01Q 5/371* (2015.01); *H01Q 15/14* (2013.01)

(58) Field of Classification Search

CPC ..... H01Q 5/371; H01Q 21/00; H01Q 21/26; H01Q 21/28; H01Q 1/36

See application file for complete search history.

(56) References Cited

U.S. PATENT DOCUMENTS

| | | | |
|---|---|---|---|
| 9,413,062 | B2 | 8/2016 | Ortiz |
| 2004/0080457 | A1 | 4/2004 | Guo et al. |
| 2013/0229318 | A1 | 9/2013 | Ng et al. |
| 2016/0036127 | A1 | 2/2016 | Desclos et al. |

*Primary Examiner* — Robert Karacsony

(74) *Attorney, Agent, or Firm* — Dority & Manning, P.A.

(57) ABSTRACT

A two antenna assembly for use in MIMO systems is described where wide beamwidth performance is achieved over wide frequency ranges while maintaining high isolation and low envelope correlation between the antenna elements in a low profile, small form factor. This MIMO antenna system is optimal for use in DAS systems for in-building applications where a MIMO antenna system is required and a low profile is desirable for ceiling and wall mount applications. The antenna assembly is designed to maintain low Passive Intermodulation (PIM) characteristics across multiple cellular frequency bands. Each antenna in the pair of elements is configured to cover multiple cellular frequency bands to provide a single port per antenna for use with multiple transceivers. A single conductor radiator design for the antenna elements simplifies manufacturing of the antenna. A tuned parasitic element is positioned between the antenna elements to enhance isolation at specific portions of the frequency range.

10 Claims, 12 Drawing Sheets

WIDEBAND WIDE BEAMWIDTH MIMO ANTENNA SYSTEM

CROSS-REFERENCE TO RELATED APPLICATIONS

This application is a divisional of U.S. Ser. No. 15/150,331, filed May 9, 2016;

which claims benefit of priority with U.S. Ser. No. 62/159,103, filed May 8, 2015;

the contents of each of which are hereby incorporated by reference.

FIELD OF INVENTION

The present invention relates generally to the field of wireless communication. In particular, the present invention relates to MIMO antenna configurations where wide beamwidth and wide frequency bandwidths are desirable for use in wireless communications.

BACKGROUND OF THE INVENTION

Continued adoption of cellular systems for data transfer as well as voice communications along with introduction of new mobile communications devices such as Tablet devices make cellular coverage in urban environments a priority. In particular, improving cellular coverage indoors is important to provide a seamless user experience in the mobile communication arena. Distributed antenna systems (DAS) are being installed in office buildings and public areas and are used to provide stronger RF signals to improve the communication link for cellular and data services.

Initial DAS antenna systems were only required to operate over a few frequency bands, making the antenna design process easier. As the communications industry has moved from 2G to 3G cellular systems, and with the advent of 4G communication systems such as Long Term Evolution (LTE), additional frequency bands are required from a DAS antenna system which increases the difficulty in terms of antenna design. With the adoption of 4G LTE cellular systems the need for a two antenna assembly to provide MIMO (Multiple Input Multiple Output) capability is required for in-building DAS systems. This requirement for a two antenna pair at multiple locations for in-building applications puts more importance on antenna assembly size reduction to minimize visual impact of these antennas when a full system is installed.

As communication systems such as DAS transition to MIMO capability to assist in servicing a growing demand for higher data rates for in-building mobile communication users, and as more users access high data rate features such as file sharing and video downloads the signal to noise characteristics and RF signal levels of the cellular signals indoors become more important parameters. To maintain low noise floors in communication systems a parameter that is important to address in the antenna design is Passive Intermodulation (PIM). PIM products are generated when two RF signals at different frequencies are injected into an antenna port; the antenna, though being a passive device, can generate spurious responses due to "natural diode" junctions in the antenna. These natural diode junctions can be formed at the junction of two metal surfaces where the metals are dissimilar. Corrosion and oxidation at these junctions can also cause spurious frequency components due to mixing of the two RF signals. Proper antenna design and material selection is important to meet stringent, low PIM requirements. As PIM components increase, these spurious frequency components add to the noise level, which in turn results in reduced signal to noise ratio of the communication system. This will result in reduced data rates for users.

The desire for a small form factor MIMO antenna system that can cover wide frequency ranges and possess wide beamwidth characteristics across these wide frequency ranges brings difficult design challenges in terms of maintaining high port to port isolation for the antenna pair as well as maintaining low envelope correlation coefficient (ECC). Maintaining the isolation and ECC requirements are key to providing the antenna characteristics needed on the base station or node side of the communication link to achieve the increased data rates a MIMO communication system can delivered compared to SISO (Single Input Single Output) systems. Port to port isolation in particular can be difficult to achieve when wide frequency bandwidths are required and the inter-element spacing is small. With isolation typically being dependent on antenna element separations as a function of a wavelength, maintaining acceptable isolation at the lower frequency bands can be the challenge as well as degraded isolation at narrow band regions at the higher frequencies when wide frequency bandwidths are attempted in an antenna system design.

SUMMARY OF THE INVENTION

This patent describes a two antenna assembly for use in MIMO systems where wide beamwidth performance is achieved over wide frequency ranges while maintaining high isolation and low envelope correlation between the antenna elements in a low profile, small form factor. High isolation and low ECC are achieved in this design to allow for good MIMO system operation. Low PIM performance is maintained for both antennas in the system.

The antenna system comprising: pair of antenna elements positioned on a small ground plane, with the two antenna elements being identical in design. The antenna design consists of a first conductor portion oriented orthogonal to the ground plane with four conductor portions or "arms" extending from the First portion. The first portion is positioned close to the ground plane but is not connected to the ground plane. The length of each of the four portions is different, with the lengths chosen to resonate at a specific frequency. The two longest portions are chosen to resonate to cover a lower frequency resonance and the two shortest portions are chosen to resonate to cover a higher frequency resonance. For optimal efficiency the two low frequency portions are positioned higher above the ground plane, with the portions being planar and parallel to the ground plane. The high frequency portions are planar and oriented perpendicular to the ground plane. The two antennas can be symmetrically positioned on the ground plane, though isolation and correlation can be improved by rotating one antenna in relation to the other antenna.

BRIEF DESCRIPTION OF THE DRAWINGS

FIG. 11 shows the measured isolation performance of the wide band wide beamwidth MIMO antenna system.

DESCRIPTION OF THE INVENTION

Figure 1:
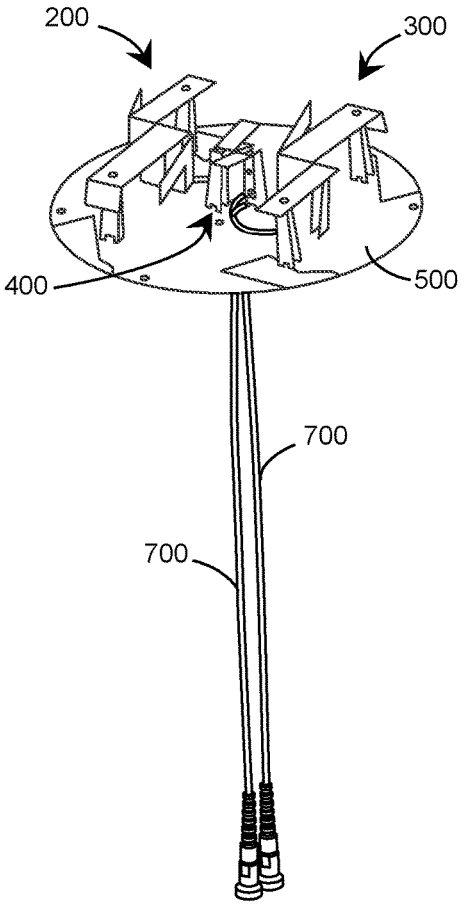
FIG. 1 shows an internal view of the antenna system, with two antenna elements, a radiating element, and a pair of coaxial cables protruding from the bottom.

A two antenna assembly for use in MIMO systems is described where wide beamwidth performance is achieved over wide frequency ranges while maintaining high isolation and low envelope correlation between the antenna elements in a low profile, small form factor. High isolation and low ECC are achieved in this design to allow for good MIMO system operation. Low PIM performance is maintained for both antennas in the system.

One embodiment of this invention is a pair of antennas elements positioned on a small ground plane, with the two antennas elements being identical in design. The antenna design consists of a first portion of the antenna element oriented orthogonal to the ground plane with four portions or "arms" extending from the first portion. The first portion is positioned close to the ground plane but is not connected to the ground plane. The length of each of the four portions is different, with the lengths chosen to resonate at a specific frequency. The two longest portions are chosen to resonate to cover a lower frequency resonance and the two shortest portions are chosen to resonate to cover a higher frequency resonance. For optimal efficiency the two low frequency portions are positioned higher above the ground plane, with the portions being planar and parallel to the ground plane. The high frequency portions are planar and oriented perpendicular to the ground plane. The two antennas elements can be symmetrically positioned on the ground plane, though isolation and correlation can be improved by rotating one antenna in relation to the other antenna.

In another embodiment of the invention a resonating element can be positioned between the two antennas, with this resonating element dimensioned to resonate at a frequency where isolation improvement is desired. This resonating element will intercept some of the power that would normally be coupled between antenna elements and acts as a reflector to reduce the amount of power coupled. The resonating element can be shaped and dimensioned to work as a linear element where the length of the element can be selected to resonate at the desired frequency. This resonating element is referred to as a reflector element. To further optimize the two antenna system for isolation as well as impedance match and bandwidth, the two antennas can be positioned on the ground plane in an orientation that places two high frequency portions next to one another. The high frequency conductor portions can be bent to choose a separation distance between the portions and the reflector element placed between the two antennas. By bending the high frequency portions closer to the reflector element the isolation at a specific frequency can be improved due to the amount of coupling between each antenna and the reflector assembly. This reflector element used to improve isolation can be designed and implemented where the reflector does not connect to the ground plane or either antenna element which will result in the ability to achieve low PIM levels from the MIMO antenna design.

In yet another embodiment of this invention multiple reflector elements can be positioned between the two antenna elements or in the vicinity of the two antenna elements to improve isolation between the antennas. The reflector elements can be tuned to resonate at different frequencies to provide isolation improvement at these different frequencies. Alternately, multiple reflector elements can be tuned to resonate at the same frequency to improve isolation at a specific frequency.

In another embodiment of this invention a circular ground plane is used with the two identical antenna elements and the two antenna elements are positioned symmetrically offset from the center of the circular ground plane. The shortest high frequency portion and the shortest low frequency portion are positioned towards the outer edge of the ground plane, while the longest high frequency portion and the longest low frequency portion are positioned towards the center of the ground plane. This antenna element orientation will provide a more constant radiation pattern for the antenna across wide frequency bands by providing more ground plane for the lower frequency portions of both the low band and high band resonances. With this configuration the longest high frequency portions will be closest to the center of the ground plane and closest to each other, so the reflector element can be designed to provide improved isolation at the low end frequency region of the high frequency band response.

In another embodiment of this invention a portion of the ground conductor within the vicinity of one or more of the two low frequency conductors which form an antenna element can be removed, forming a slot in the ground conductor to increase bandwidth of the low band resonance. This method of ground plane removal beneath the low frequency conductors can be applied to one or both antennas in the MIMO assembly, and the resultant ground plane shape can be non-symmetrical. Impedance bandwidth is the parameter that can best be altered using this method, but an additional benefit is the ability to change the radiation pattern characteristics at the low frequency resonance. Specifically the front to back ratio of the radiation pattern can be changed by removing ground plane beneath the antenna arms or conductors.

In another embodiment of this invention a portion of the ground plane within the vicinity of one or more of the two high frequency conductors which form an antenna element can be removed to change radiation patterns at the high frequency resonance. This alteration of the ground plane can take the form of a portion along an outer edge of the ground plane removed or a region of the ground plane internal from the outer edge. An enclosed region of the ground plane can be removed beneath or in the vicinity of one or multiple high frequency arms or conductors of the antenna element to modify the radiation pattern at the high frequency resonance. Using this method to alter radiation patterns will result in the capability to change radiation patterns at the high frequency band without changing radiation pattern characteristics at the low frequency band.

In another embodiment of this invention a conductive layer applied to a dielectric substrate is used to couple the center conductor of the coaxial transmission line and the antenna element. This method provides a capacitively coupled feed configuration to eliminate metal on metal contact which results in improved PIM performance. This capacitively coupled technique will also result in a method of coupling the transmission line to an aluminum element or other conductive material that is more difficult to solder to. Using aluminum for the antenna elements has dual benefits compared to copper compositions in terms of both cost and weight savings. With the antenna element previously described not requiring a ground connection, this capacitively coupled feed allows for the entire antenna to be isolated from the ground and transmission line.

Now turning to the drawings, FIG. 1 shows an internal view of the antenna system comprising: two antenna elements, a radiating element, and a pair of coaxial cables protruding from the bottom. A first antenna element 200 and a second antenna element 300 are shown which represent the two antennas in this MIMO antenna system. Also shown is a third element which is a resonating element 400 positioned between the two antennas and is used to improve isolation between these antennas. Two coaxial cables 700 protrude from the bottom side of the ground conductor 500.

Figure 2:
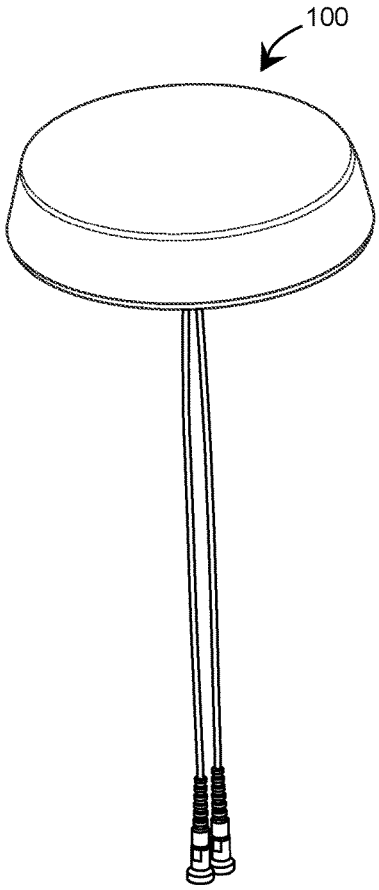
FIG. 2 shows a perspective view of a complete wide band wide beamwidth MIMO antenna system.

FIG. 2 shows a perspective view of a complete wide band wide beamwidth MIMO antenna system 100.

Figure 3:
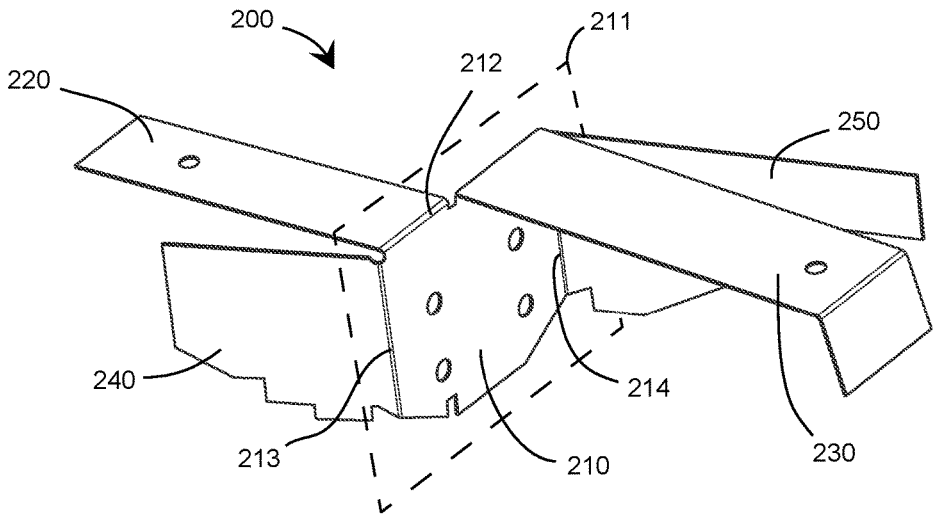
FIG. 3 shows the conductor configuration used to form the antenna element; a first conductor portion provides a centrally positioned junction for four additional conductor portions to attach to. Two low frequency portions along with two high frequency portions are shown.

FIG. 3 shows the conductor configuration used to form the first and second antenna elements 200,300. Each of the first and second antenna elements is formed from a planar sheet, the first and second antenna elements each individually comprise a first conductor portion 210 and four additional conductor portions extending therefrom.

Said first portion 210 comprising a top edge 212, a first side edge 213, and a second side edge 214, opposite the first side edge. Said first portion extending within a vertical plane 211, with a second 220, a third 230, a fourth 240, and a fifth 250 conductor portion each attached to said first portion.

The second portion 220 is shown extending from the top edge 212 and arranged perpendicular with respect to the first portion 210. The third portion 230 is shown extending from the top edge 212 and arranged perpendicular with respect to the first portion 210, but extending in a direction opposite the second portion 220. A fourth portion 240 is shown extending from the first side edge 213 of the first portion and bent such that it is not in the plane of either the first, second, or third portions. A fifth portion 250 is shown extending from the second side edge 214 of the first portion 210 and bent such that it is not in the plane of either the first, second, or third portions.

The length of each of the four portions of each antenna element is different, with the lengths chosen to resonate at a specific frequency. The two longest portions are chosen to resonate to cover a lower frequency resonance and the two shortest portions are chosen to resonate to cover a higher frequency resonance.

Figure 4:
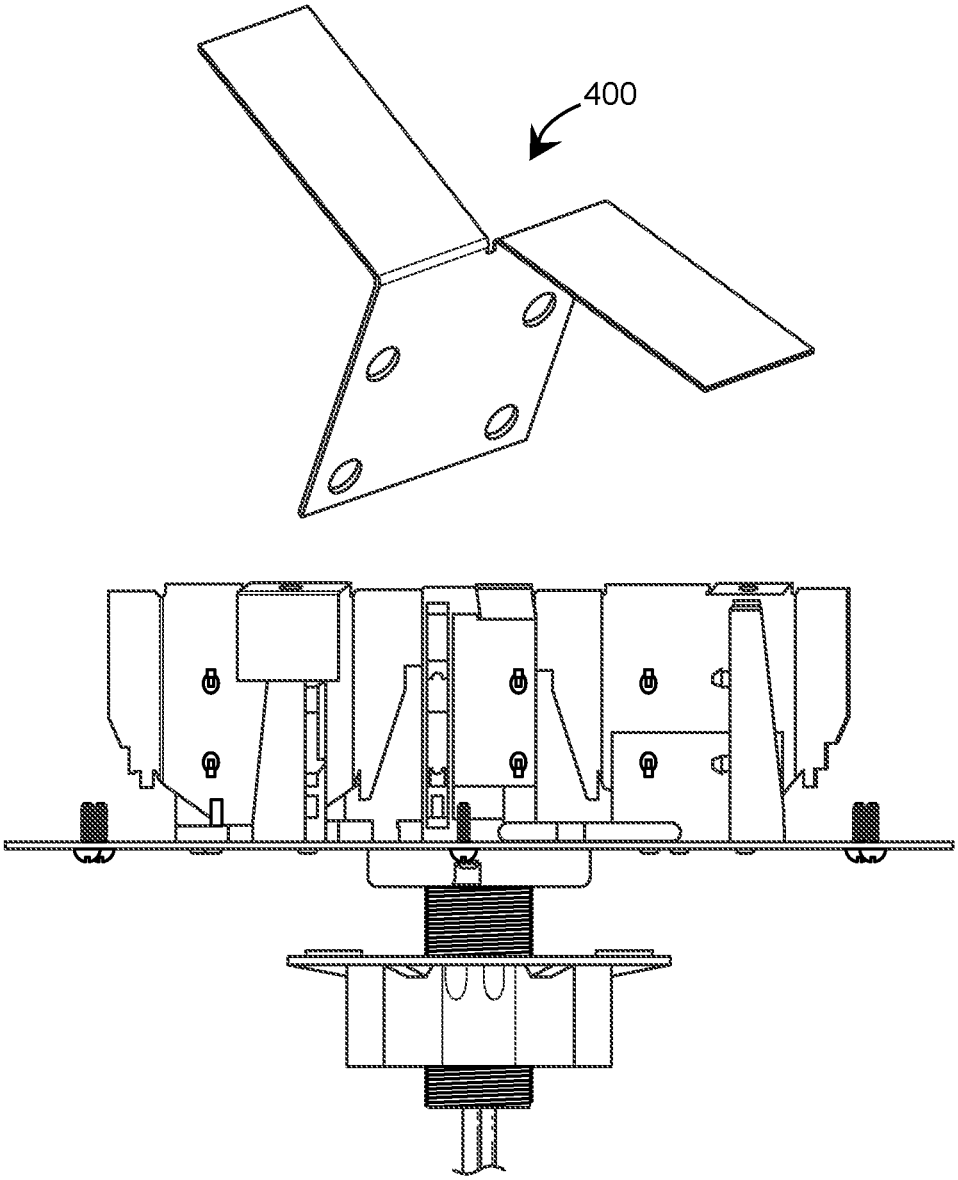
FIG. 4 shows a resonating element that can be positioned between the two antenna elements in the antenna system to improve isolation between the antennas.

FIG. 4 shows a resonating element 400 that can be positioned between the first and second antenna elements in the MIMO antenna system to improve isolation between the antennas. The reflector assembly is shown in the antenna assembly and the reflector is elevated and isolated from the ground plane.

Figure 5:
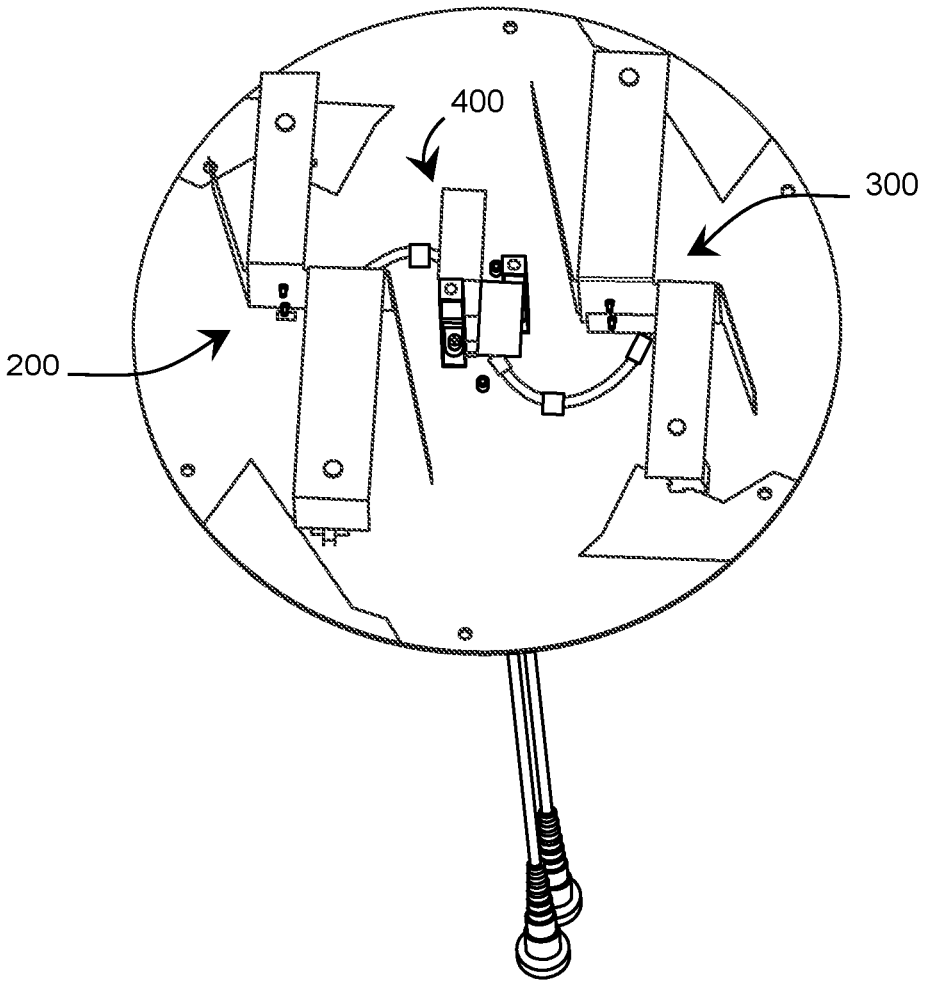
FIG. 5 shows the location of the reflector element in relation to the two antenna elements.

FIG. 5 shows the location of the resonating element 400 in relation to the two antenna elements 200,300. Here the second antenna element 300 is shown rotated one hundred eighty degrees with respect to the arrangement of the first antenna element 200. The high frequency conductors of each antenna are designated and it is noted that the bend angle of these high frequency conductors can be chosen to improve isolation at a specific frequency.

Figure 6:
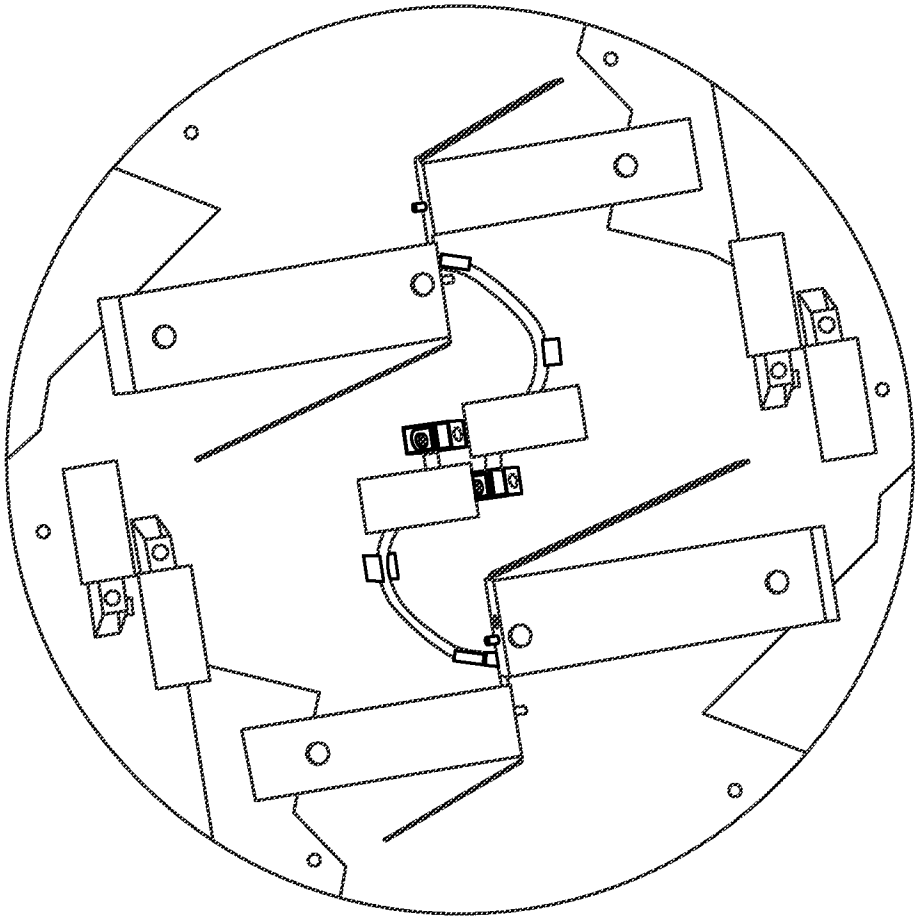
FIG. 6 shows a wide band wide beamwidth MIMO antenna system wherein three reflector elements are positioned in the vicinity of the two antenna elements.

FIG. 6 shows a wide band wide beamwidth MIMO antenna system wherein three reflector elements are positioned in the vicinity of the two antenna elements. The high frequency conductors of each antenna is designated and it is noted that the bend angle of these high frequency conductors can be chosen to improve isolation at a specific frequency by controlling the coupling to the reflector element between the two antennas.

Figure 7:
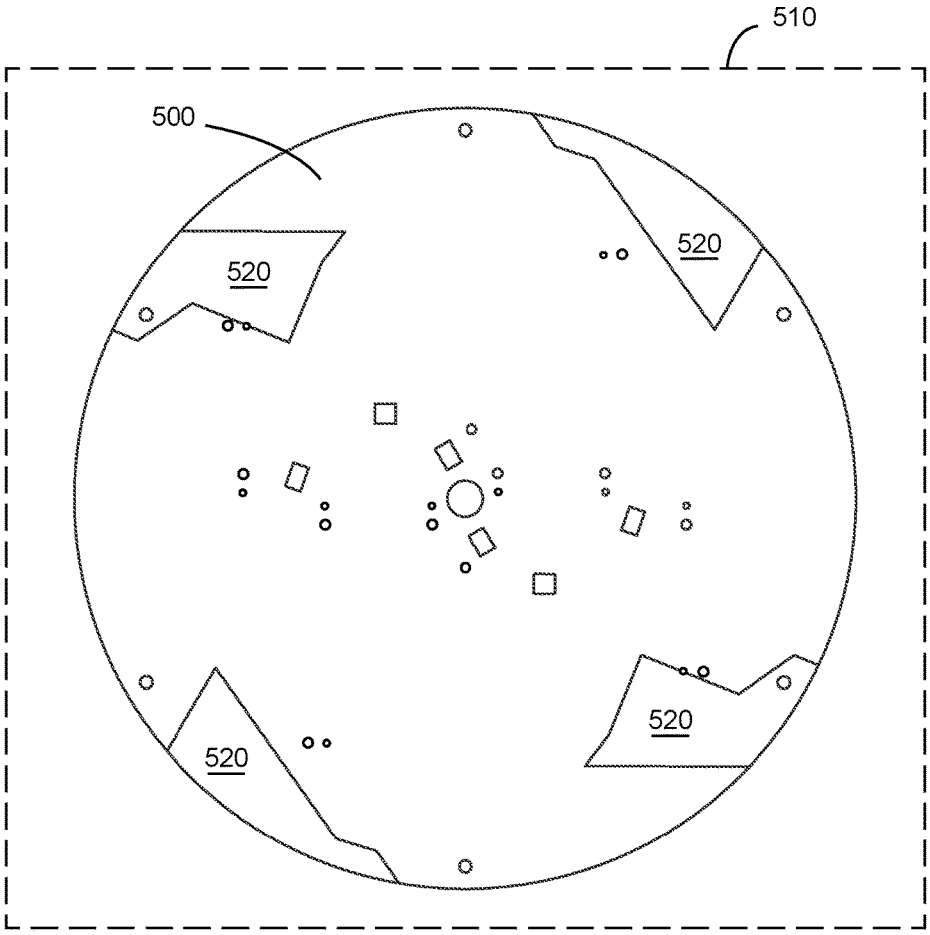
FIG. 7 shows a ground plane configuration implemented in the antenna system wherein the ground plane is circular and contains four slots along the outer diameter where conductive material has been removed.

FIG. 7 shows the ground plane configuration implemented in the wide band wide beamwidth MIMO antenna system. In this case the ground conductor 500 forming the ground plane 510 is circular and contains four slots 520, or sections along the outer diameter where conductive material has been removed.

Figure 8:
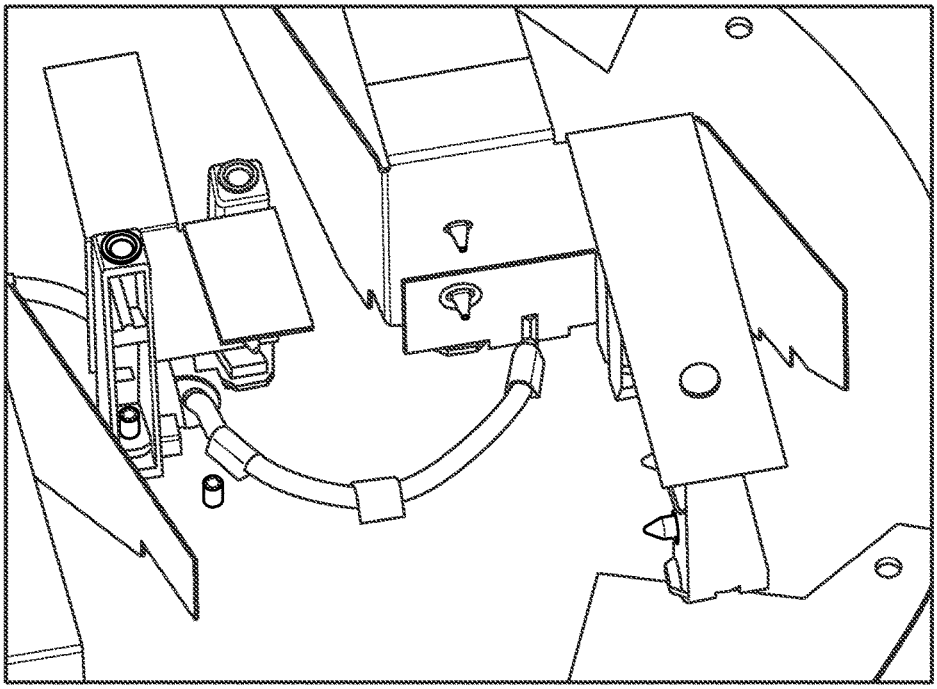
FIG. 8 shows a specific section of ground plane removed in the vicinity of the various low and high frequency conductors, at low frequencies the removal of ground plane beneath the low frequency conductor will result in a larger bandwidth.

FIG. 8 shows the concept of removing a specific section of ground plane in the vicinity of the various low and high frequency conductors. At low frequencies the removal of ground plane beneath the low frequency conductor will result in a larger bandwidth.

Figure 9:
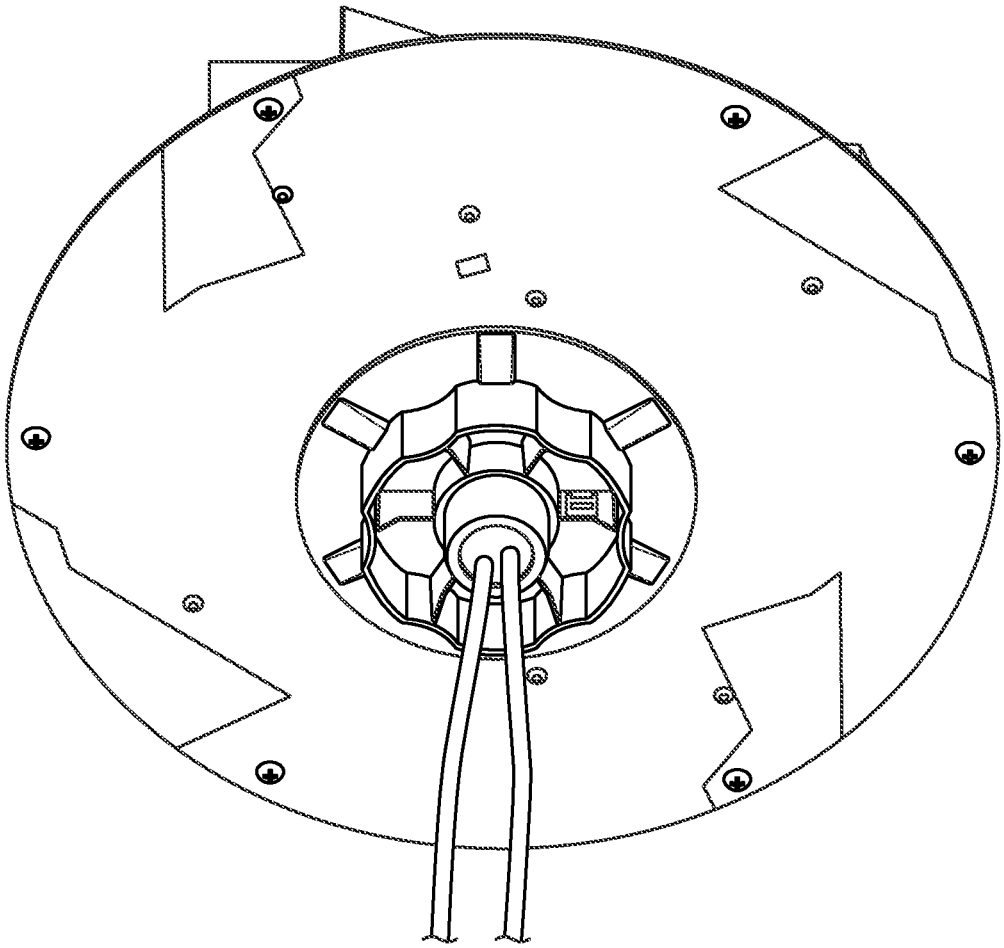
FIG. 9 shows the bottom side of the ground plane of an assembled MIMO antenna system.

FIG. 9 shows the bottom side of the ground plane of an assembled MIMO antenna system.

Figure 10:
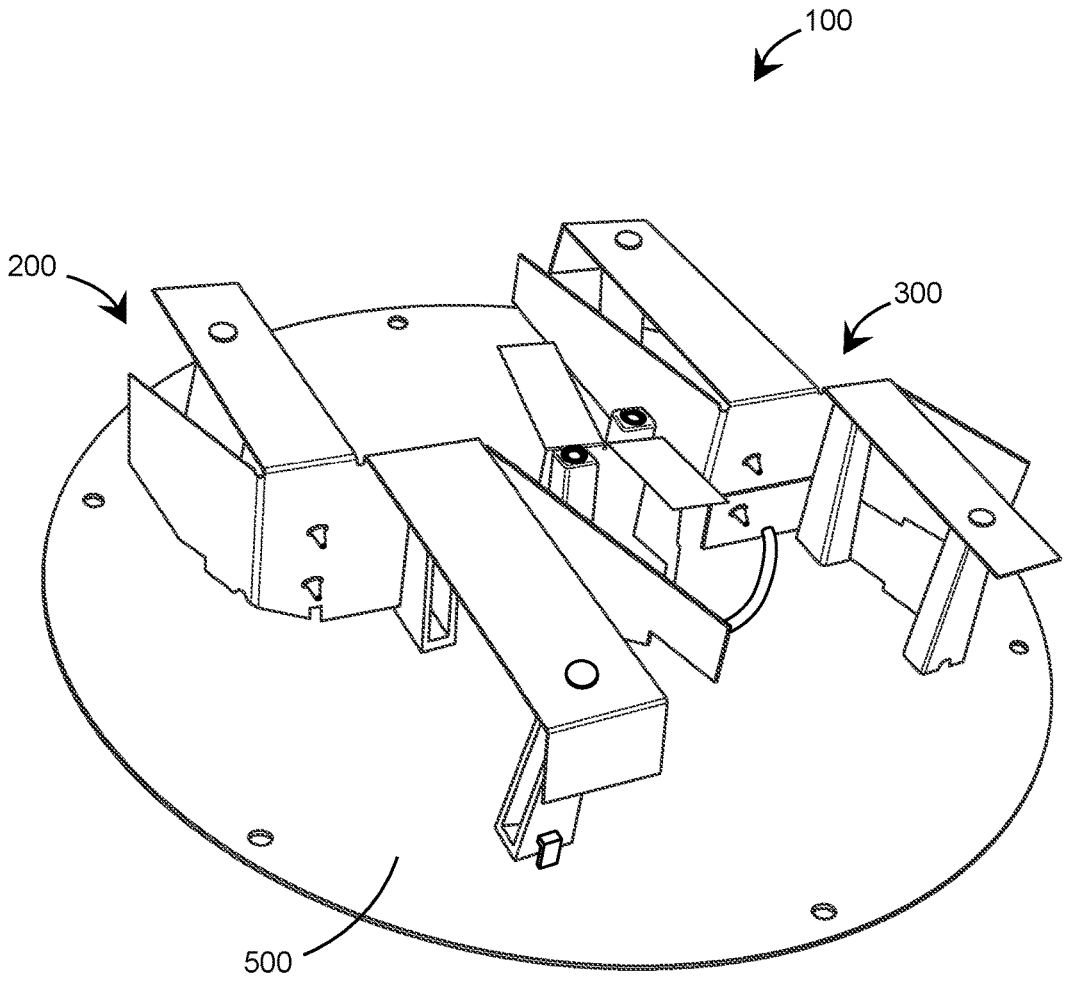
FIG. 10 shows an example of a wide band wide beamwidth MIMO antenna system with two antenna elements, and a resonating element configured on a ground plane.

FIG. 10 shows an example of a wide band wide beamwidth MIMO antenna system that was built and tested. The antenna system 100 is shown comprising: a first and second antenna element 200,300, and a ground conductor 500. The ground conductor 500 is positioned in proximity to the first and second antenna elements, the ground conductor 500 associated with the first and second antenna elements, wherein the first portion of each of the first and second antenna elements is configured in a perpendicular relation with respect to the ground conductor.

Figure 11:
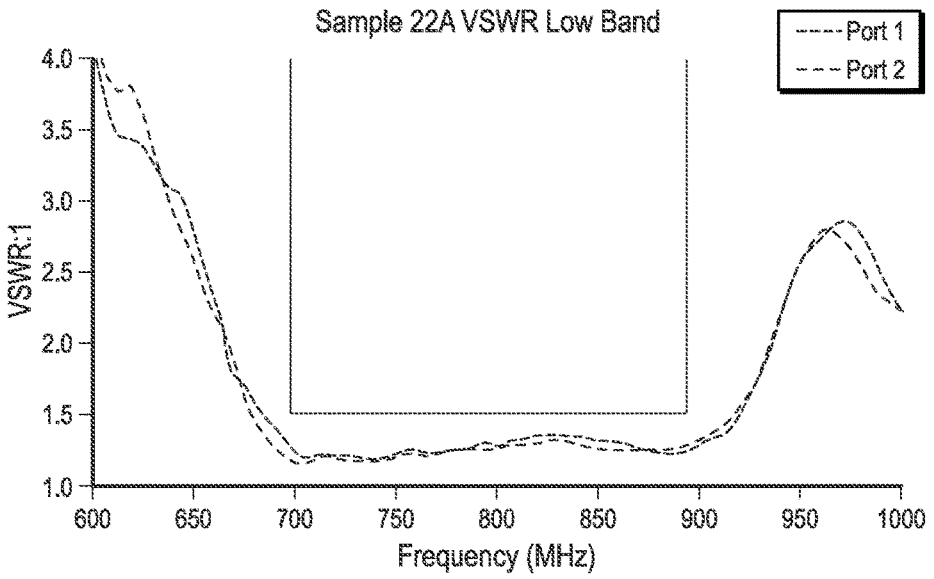
FIG. 11 shows plots of measured VSWR (Voltage Standing Wave Ratio) for the wide band wide beamwidth MIMO antenna system.
Figure 11:
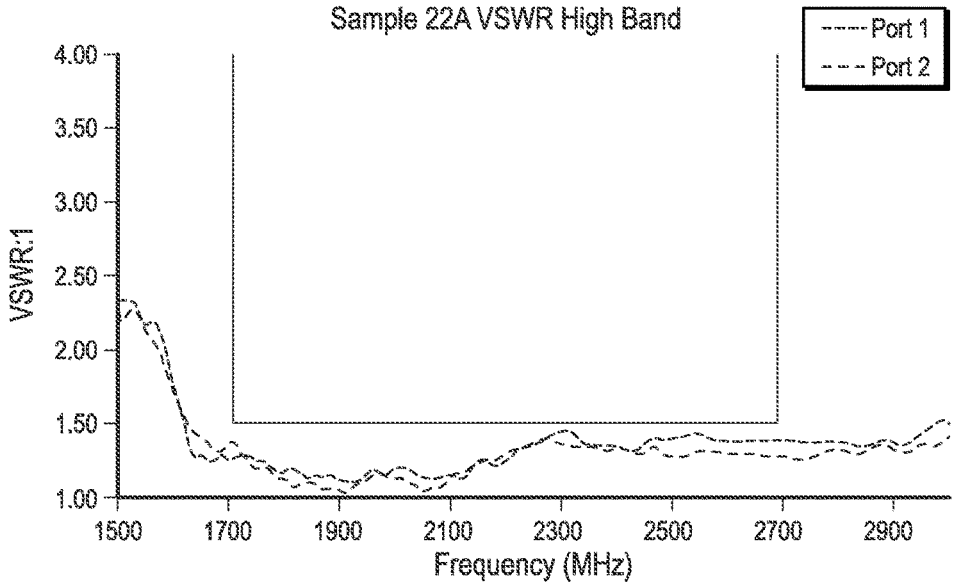

FIG. 11 shows plots of measured VSWR (Voltage Standing Wave Ratio) for the wide band wide beamwidth MIMO antenna system. A low VSWR is achieved across wide frequency ranges at both low and high frequencies.

Figure 12:
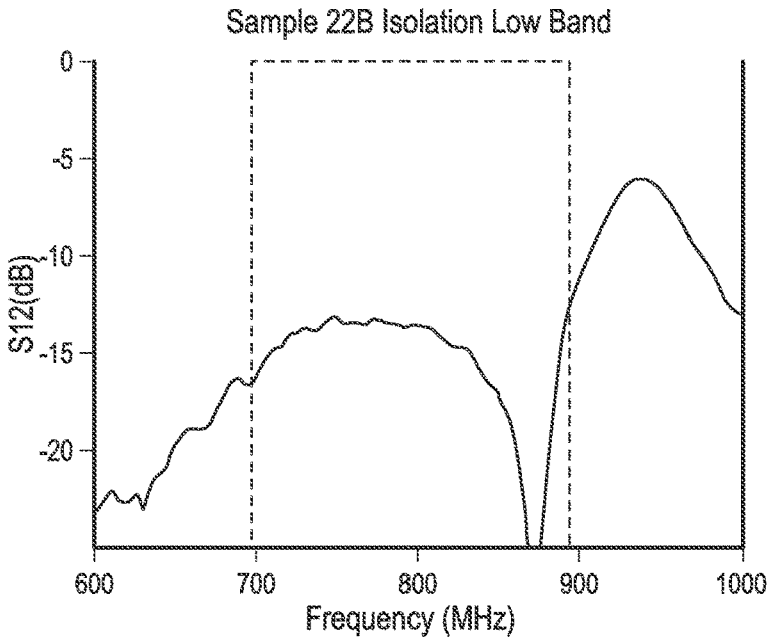
FIG. 12 shows the measured radiation pattern performance of the wide band wide beamwidth MIMO antenna system at 850 and 1850 MHz.
Figure 12:
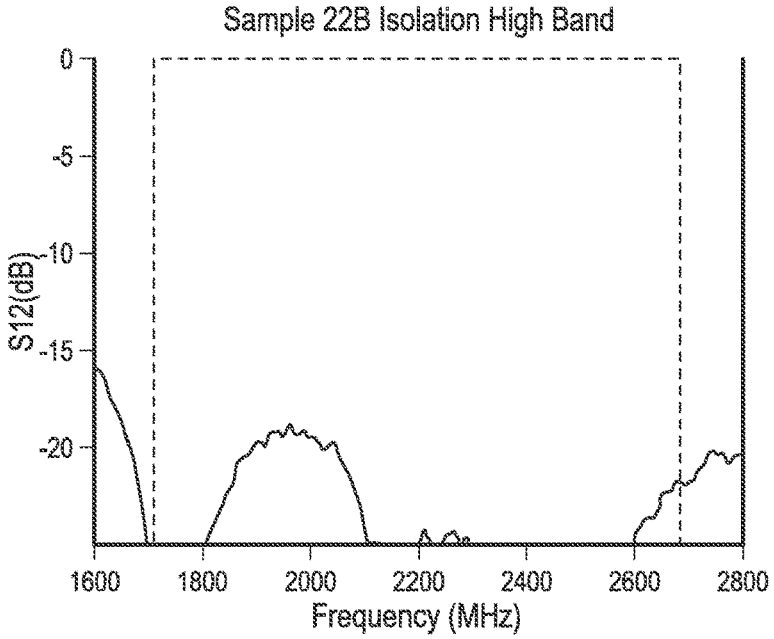

FIG. 12 shows the measured isolation performance of the wide band wide beamwidth MIMO antenna system. The region where isolation improvement is achieved due to the reflector element is shown on the high frequency band plot.

Figure 13:
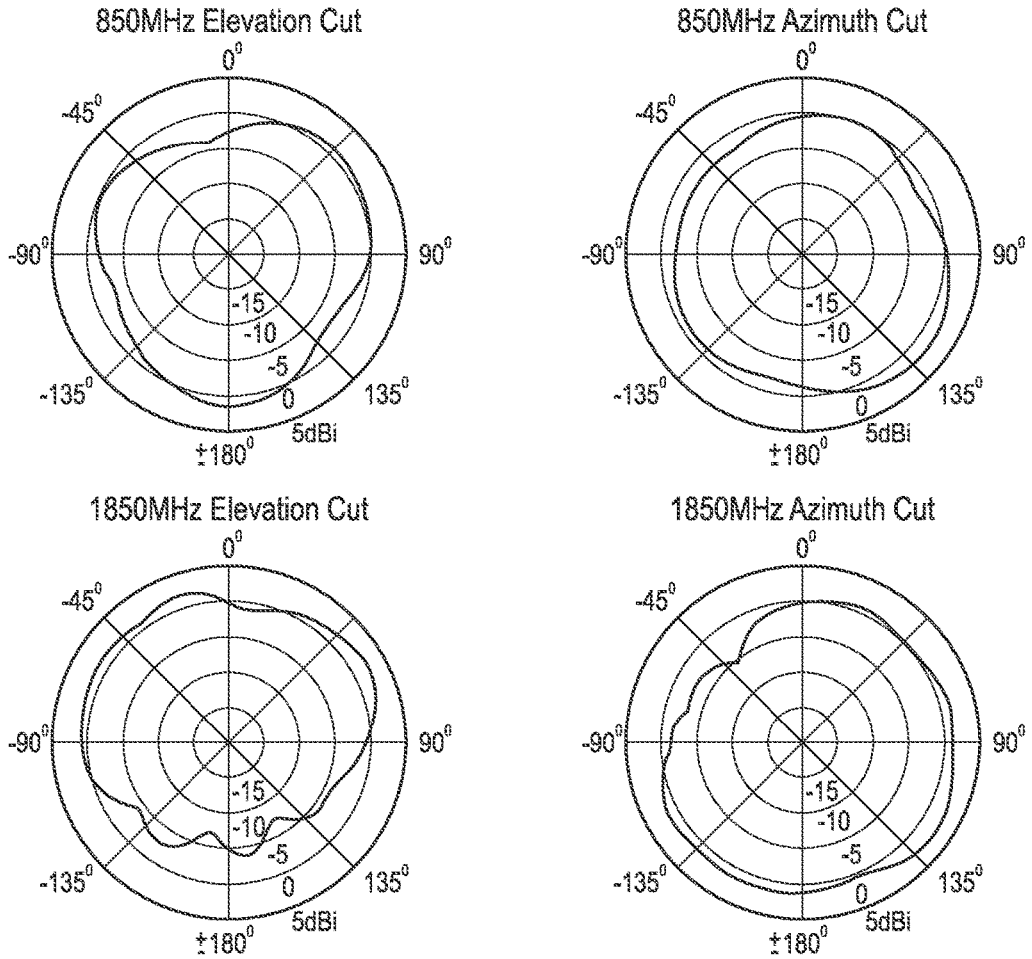
FIG. 13 shows the measured radiation pattern performance of the wide band wide beamwidth MIMO antenna system.

FIG. 13 shows the measured radiation pattern performance of the wide band wide beamwidth MIMO antenna system. Measured radiation patterns at 850 and 1850 MHz are shown. Wide beamwidth characteristics are maintained over a wide frequency range.

FEATURE LIST antenna system (100)
first antenna element (200)
first portion (210)
vertical plane (211)
top edge (212)
first side edge (213)
second side edge (214)
second portion (220)
third portion (230)
fourth portion (240)
fifth portion (250)
second antenna element (300)
resonating element (400)
ground conductor (500)
ground plane (510)
slot (520)
Coaxial Cables (700)

We claim:

1. An antenna system comprising:

a first antenna element and a second antenna element, each of the first and second antenna elements formed from a planar sheet, the first and second antenna elements each individually comprising:

a first portion extending within a vertical plane and comprising a top edge, a first side edge, and a second side edge opposite the first side edge, a second portion extending from the top edge and arranged perpendicular with respect to the first portion, a third portion extending from the top edge and arranged perpendicular with respect to the first portion, the third portion extending in a direction opposite of the second portion, a fourth portion extending from the first side edge of the first portion and bent such that it is not in the plane of either the first, second, or third portions, and a fifth portion extending from the second side edge of the first portion and bent such that it is not in the plane of either the first, second, or third portions; and a ground conductor positioned in proximity to the first and second antenna elements, the ground conductor forming a ground plane associated with the first and second antenna elements, wherein the first portion of each of the first and second antenna elements is arranged perpendicular with respect to the ground conductor.

2. The antenna system of claim 1, wherein the second antenna element is rotated one hundred eighty degrees with respect to the arrangement of the first antenna element.

3. The antenna system of claim 1, further comprising a resonating element, wherein the resonating element is disposed between the first and second antenna elements.

4. The antenna system of claim 3, wherein the resonating element is not connected to the first and second antenna elements or the ground conductor.

5. The antenna system of claim 3, wherein the resonating element is dimensioned to resonate at a frequency for additional port to port isolation with respect to the first and second antenna elements.

6. The antenna system of claim 3, wherein the resonating element is connected to the ground conductor.

7. The antenna system of claim 1, further comprising a plurality of resonating elements, wherein each of the resonating elements is disposed between the first and second antenna elements.

8. The antenna system of claim 1, comprising at least one slot disposed within the ground conductor.

9. The antenna system of claim 1, further comprising a first capacitively coupled feed, the first capacitively coupled feed being coupled to the first antenna element, wherein the first capacitively coupled feed comprises a dielectric substrate and a conductive layer disposed on the dielectric substrate, and wherein the conductive layer is arranged to provide a capacitive coupling with the first antenna element.

10. The antenna system of claim 9, wherein each of the first and second antenna elements comprises a capacitively coupled feed.

* * * * *